US011480131B2

(12) United States Patent
Sethy et al.

(10) Patent No.: US 11,480,131 B2
(45) Date of Patent: Oct. 25, 2022

(54) ENGINE BLOCK FOR AN INTERNAL COMBUSTION ENGINE

(71) Applicant: GM GLOBAL TECHNOLOGY OPERATIONS LLC, Detroit, MI (US)

(72) Inventors: Asok K. Sethy, Bangalore (IN); Abhishek Kumar Sahu, Karnataka (IN)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 1073 days.

(21) Appl. No.: 16/132,633

(22) Filed: Sep. 17, 2018

(65) Prior Publication Data

US 2020/0088126 A1 Mar. 19, 2020

(51) Int. Cl.
*F02F 1/00* (2006.01)
*F02B 75/18* (2006.01)

(52) U.S. Cl.
CPC ..... *F02F 1/004* (2013.01); *F02B 2075/1808* (2013.01); *F02F 2001/008* (2013.01)

(58) Field of Classification Search
CPC ..... F02B 2075/1808; F02F 1/004; F02F 2001/008
See application file for complete search history.

(56) References Cited

U.S. PATENT DOCUMENTS 2,094,254 A * 9/1937 Brubaker ..... F02F 11/005 92/169.1
3,769,880 A 11/1973 Mirjanic
7,806,098 B2 10/2010 Bing et al.
8,695,558 B2 4/2014 Reymond et al.
10,359,000 B2 7/2019 Gniesmer
2010/0263619 A1* 10/2010 Reymond ..... F02F 1/004 123/193.2
2018/0010549 A1* 1/2018 Gniesmer ..... F02F 1/16

FOREIGN PATENT DOCUMENTS

DE 10146850 A1 1/2003
GB 1473756 A 5/1977
WO WO2013175094 A1 11/2013

OTHER PUBLICATIONS

German office action for DE Application No. 10 2019 114 775.1; Report dated Jan. 29, 2021 (pp. 1-5).

* cited by examiner

*Primary Examiner* — Grant Moubry
*Assistant Examiner* — Ruben Picon-Feliciano
(74) *Attorney, Agent, or Firm* — Cantor Colburn LLP

(57) ABSTRACT

The present disclosure provides a cylinder block for an internal combustion engine having a first cylinder, a first cylinder sleeve, a second cylinder, and a second cylinder sleeve. The first cylinder defines a first cylindrical wall while the second cylinder defines a second cylindrical wall. The first cylinder sleeve lines the first cylindrical wall while the second cylinder sleeve lines the second cylindrical wall. Each of the first and the second cylinder sleeves define a thrust sleeve region, an anti-thrust sleeve region opposite the thrust sleeve region, and a pair of Siamese regions. The outer wall of each of the first and second cylinder sleeves progressively widens toward the top sleeve surface of each of the first and second cylinder sleeves.

14 Claims, 6 Drawing Sheets

ENGINE BLOCK FOR AN INTERNAL COMBUSTION ENGINE

TECHNICAL FIELD

The present disclosure relates to a cylinder block especially for internal combustion engines.

BACKGROUND

In its most general form, an internal combustion engine, or heat engine, includes an engine block in which at least one cylinder is formed, inside which a piston is movably mounted and connected to a crankshaft by a connecting element such as a rod. The engine block comprises three main parts, one of which is called a cylinder block, as it has one or more cylinders.

The cylinder block is covered on one side with a cylinder head (the second main part), in which the means necessary for internal combustion are arranged: in particular, intake means, exhaust means and optional ignition means. On the other side, the cylinder block is covered with an engine crankcase in which a crankshaft (the third main part) is housed.

With reference to FIGS. 2A and 2B, when the combustion engine is the linear-motion piston type, as opposed to a rotary piston engine, the engine block has at least one cylinder 112 lined by a straight sleeve 120, inside which a piston 180 can move translationally, connected to the crankshaft by a rod. The cylinder bore 112 is in the shape of a circle and the straight sleeve 120 also has a Siamese region width 154 throughout the straight sleeve 120. The cylinder head (not shown) for this cylinder block in FIGS. 2A and 2B comprises the distribution means for the cylinder or for each of the cylinders: for example, at least one intake valve, at least one exhaust valve, and an optional spark plug, as well as mechanical means for controlling the valves. And the engine crankcase contains the crankshaft and the rod and the oil reservoir needed to lubricate the engine.

Gaskets are used to form a seal between the three main parts of the combustion engine: namely, between the cylinder block and the cylinder head, and between the cylinder block and the engine crankcase. More specifically, the upper seal—i.e., the seal between the cylinder block and the cylinder head—is formed by a cylinder head gasket developed specifically for this purpose.

No matter what mode of operation such an internal combustion engine uses—i.e., two-stroke or four-stroke, compression ignition or spark ignition—this operation will always include the following stages for each of the cylinders: an intake of a fuel and the air needed for combustion, a compression of the fuel/air mixture, an internal combustion of the fuel/air mixture, and an exhausting of the combusted fuel. These four stages are organized into two or four cycles by using an appropriate combustion engine architecture.

It is easy to understand why the design of the internal combustion engine and the choice of material from which it is made are primarily determined by the stresses to which the engine is subjected during the combustion stage, which is a true explosion, On the other hand, a compromise is sought between an engine that is resistant enough to the static and dynamic stresses to which it is exposed during its operation and an engine that is as light as possible. Taking into account the engine's ability to withstand static stresses and dynamic stresses during its operation, a compromise is sought between 1) an engine that is rigid enough to be able to withstand the pre-stressing forces from the clamp loads of the cylinder head and crankcase, plus the expansion forces resulting from the internal combustion or explosion stages, depending on the thermodynamic cycles and 2) a flexibility or resilience to absorb expansion forces and thereby minimize deformations that could result from the forces and other stresses.

Indeed, deformations are generally related to the dynamic stresses of the thermodynamic cycles. But they are also caused by the pre-stressing forces from the clamp loads of the cylinder head and the head cover covering the cylinder head.

Most of the compromises found for the architecture of an internal combustion engine that incorporate both resistance to stresses and resilience to deformation has to do with the engine design and each of the cylinders is equipped with a cylinder sleeve, made of a hard material, that determines the cylinder bore size.

The cylinder sleeve can be fixed or mobile, and when it is fixed, it can be durably attached inside the cylinder block or it can be removable.

SUMMARY

The present disclosure provides a cylinder block for an internal combustion engine having a first cylinder, a first cylinder sleeve, a second cylinder, and a second cylinder sleeve. The first cylinder defines a first cylindrical wall while the second cylinder defines a second cylindrical wall. The first cylinder sleeve lines the first cylindrical wall while the second cylinder sleeve lines the second cylindrical wall. Each of the first and the second cylinder sleeves define a thrust sleeve region, an anti-thrust sleeve region opposite the thrust sleeve region, and a pair of Siamese regions. The outer wall of each of the first and second cylinder sleeves progressively widens toward the top sleeve surface of each of the first and second cylinder sleeves. It is understood that the inner and outer walls are substantially co-cylindrical within each corresponding cylinder. The inner and outer walls for each if the first and second cylinder sleeves define a top sleeve surface configured to accommodate at least part of a head gasket.

In the aforementioned example, non-limiting embodiment, the thrust sleeve region and the anti-thrust sleeve region of each of the first and second cylinder sleeves may be aligned with a corresponding thrust region and a corresponding anti-thrust region in each of the first and second cylinders. The pair of Siamese regions in the first and second cylinders may also be disposed opposite to each other. However, it is understood that one of the pair of Siamese regions defined by the first cylinder may be disposed adjacent to a Siamese region of the second cylinder. Similarly, a Siamese sleeve region in the first cylinder sleeve may be disposed proximate to another Siamese sleeve region in the second cylinder sleeve.

The outer wall of each of the first and second cylinder sleeves may define an elliptical cross section while the inner wall of each of the first and second cylinder sleeves defines a circular cross section. The first and the second cylinders each define an elliptical cylinder bore configured to align with the elliptical cross section of the outer wall of the corresponding first and second cylinder sleeves. It is further understood that the Siamese sleeve regions in the first and second cylinder sleeves are configured to undergo thermal expansion when the internal combustion reaches a predetermined temperature. Moreover, the top sleeve surface for each of the first and the second cylinder sleeves may be configured to support a stopper. In the aforementioned example, non-limiting embodiment, a combustion bead may also be spaced apart from each of the first and the second cylinder sleeves yet surrounds each of the first and the second cylinder sleeves.

It is also understood that the thrust sleeve region and the anti-thrust sleeve region each define a thick width at the top sleeve surface of each of the first and second cylinder sleeves while each Siamese region in the pair of Siamese regions in the first and second cylinder sleeves defines a Siamese region width at the top sleeve surface of each of the first and second cylinder sleeves. The thick widths are each greater than each of the Siamese region widths. Moreover, noting that the cylinder sleeve thickness progressively increases in the thrust sleeve region and the anti-thrust sleeve regions of each of the first and second cylinder sleeves, the cylinder sleeve width remains fixed in each Siamese region. Therefore, the Siamese region width at the top sleeve surface of each of the first and the second cylinder sleeves is equal to a sleeve thickness along a longitudinal length of the cylinder sleeve in each Siamese region.

Accordingly, in the aforementioned, non-limiting example embodiment, the top sleeve surface of each of the first and the second cylinder sleeves defines an elliptical shape while the bottom edge of each of the first and the second cylinder sleeves defines a circle shape. Similarly, the top opening of each of the first and the second cylinders defines an elliptical shape while a bottom surface of each of the first and the second cylinders defines a circle shape. Lastly, it is understood that the cylinder block of the present disclosure may optionally include a plurality of sets of cylinder assemblies wherein each set of cylinders assemblies includes the first cylinder, the first cylinder sleeve, the second cylinder, and the second cylinder sleeve.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figure 1:
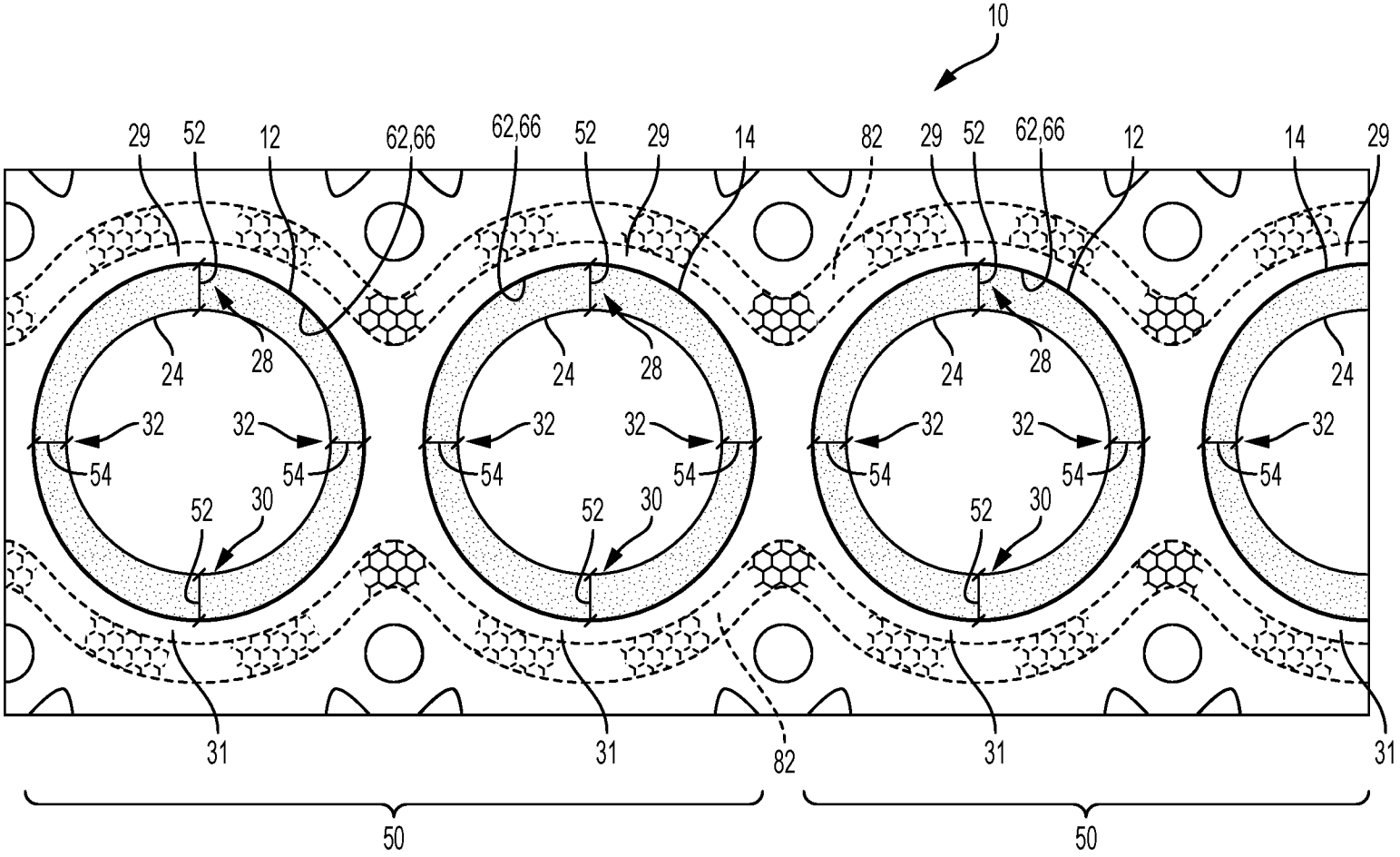
FIG. 1 is a schematic partial diagram of an engine block having cylinder chambers.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any way.

It must also be noted that, as used in the specification and the appended claims, the singular form "a," "an" and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, un-recited elements or method steps.

The phrase "consisting of" excludes any element, step, or ingredient not specified in the claim. The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

The advantage of an internal combustion engine design having a cylinder block with sleeved cylinders is to have both a light, resilient engine and rigid cylinders, especially cylinders that are hard enough to withstand the friction of the piston.

Figure 2A:
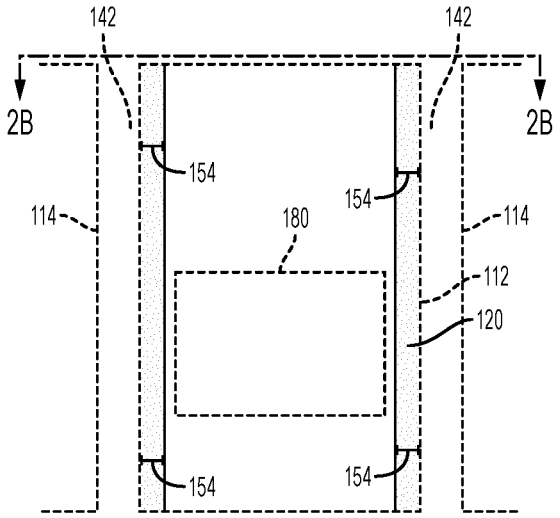
FIG. 2A PRIOR ART
FIG. 2A is a schematic cross-sectional view of a traditional engine cylinder and sleeve.
Figure 2B:
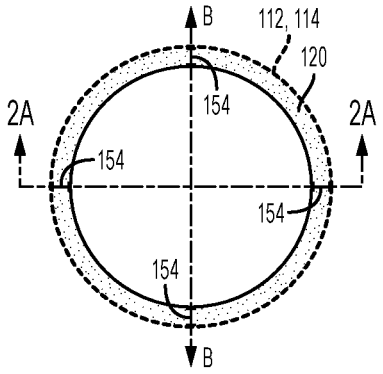
FIG. 2B PRIOR ART
FIG. 2B is a schematic plan view of the traditional engine cylinder and sleeve in FIG. 2A.

However, it has been observed that, when the cylindrical wall of a traditional cylinder is lined with a straight cylinder sleeve (See FIGS. 2A-2B), this produces a major problem that arises primarily at the time of the combustion stage, when the stresses from the explosion and attendant thermal changes are added to the stresses on the cylinder block from the compression forces. Thus, the cylinder block design, as mentioned above, must address the necessity of forming a seal between the cylinder block and the cylinder head, among other requirements. This seal is formed by means of a cylinder head gasket made of a plurality of superimposed foil sheets, for example. In this way, the cylinder head gasket is capable of forming a seal between the cylinder block and the cylinder head with a predetermined flexibility in an axial direction of the cylinder.

However, this seal can only be completely effective when the cylinder block surface facing the surface of the cylinder head behaves more or less uniformly the whole time the engine is running. It is easy to see that making the cylinder block out of two materials—i.e., the cylinder block itself from a light, relatively soft alloy and the cylinder sleeve(s) from a heavy, hard material—also results in different thermal behaviors for the two components of the cylinder block. In addition, thermal behavior requires careful consideration in the design of the cylinder block, since it is more or less difficult to design the air or liquid cooling system for the cylinder block, depending on the dimensions of the cylinder block and the number of cylinders and their arrangement.

Furthermore, in many engines the top sleeve surfaces of the cylinder sleeves are lower than a plane determined by the contact surface between the cylinder block and the cylinder head. Consequently, in such a situation the cylinder head gasket rests primarily or even exclusively on the light metal body of the cylinder block. Moreover, at the moment of combustion—that is, the moment the fuel explodes—the expansion of each of the cylinder sleeves produces extraordinary pressure on the bridge 142 (FIG. 2A) formed by the part of the cylinder block located between two neighboring cylinders. The compression exerted on this part of the cylinder block plays its own part in increasing the fragility of the cylinder block.

Another major drawback is the expansion of this very part that forms the bridge between two neighboring cylinders. This expansion exerts strong pressure, first of all, on the cylinder head gasket, because the metal becomes plastic in this part of the cylinder block. This expansion exerts strong pressure on the two neighboring sleeves as well, to "create" the space needed for its expansion. The resulting deformation of the cylinder sleeves is very detrimental to the contact between the inner walls of the sleeves and the corresponding pistons. Lastly, as the engine cools, the plasticity of the metal—particularly when it is aluminum—can cause cracks to form between the sleeves and the cylinder block, which impairs the head gasket seal. One location that is particularly subject to these stresses and is particularly critical in determining whether the cylinder block can withstand thermal stresses is the space between two neighboring cylinders.

In the traditional design of a cylinder block with at least two sleeved cylinders 112, 114 the cylinder sleeves 120 have the general shape of a straight cylindrical tube with a Siamese region width 154 wherein an inner wall guides a piston 180 translationally and an outer wall to be supported by the cylindrical wall of the recess that forms the cylinder. (See FIGS. 2A-2B). The inner and outer walls of the sleeve are substantially co-cylindrical, but not necessarily rotationally cylindrical, and they delineate between them a top sleeve surface of the sleeve intended to accommodate at least part of a head gasket.

On a traditional cylinder block having two or more cylinders, each equipped with a straight cylinder sleeve, there is an alternation between less thermally conductive hard areas, formed by the cylinder sleeves, and thermally conductive softer areas formed by different parts of the body of the cylinder block. Due to the limited space available between two neighboring cylinders, it is generally impossible to insert coolant channels so as to avoid overheating the space between two neighboring cylinders during the combustion stage. This results in a high risk of cracking, which can impair the resistance of the cylinder block to operating stresses.

Another disadvantage (often a major one) is thermal expansion of the light metal—aluminum, for example—in the space bridge 142 (FIG. 2A) between two cylinders. This exerts very strong pressure on the cylinder head gasket (the interbore area becomes plastic) and bends the sleeves in the interbore area toward the inside of the cylinder barrels, which is very detrimental to the proper piston/sleeve interaction. Accordingly, the present disclosure provides a cylinder block 10 (FIG. 1) which resolves the aforementioned issues.

Figure 3A:
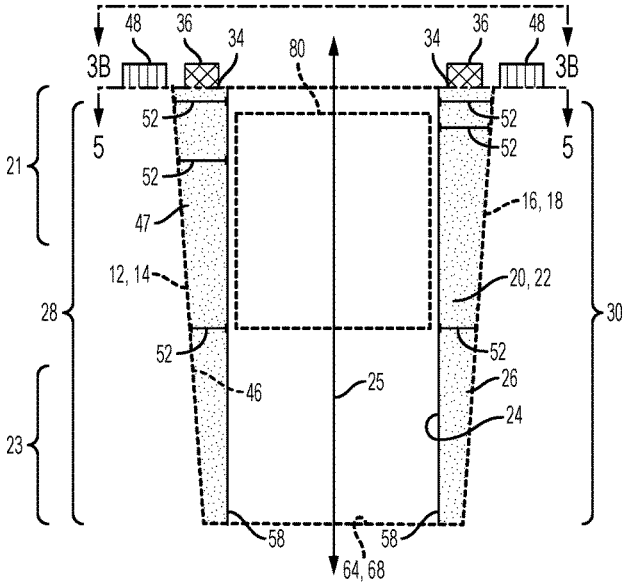
FIG. 3A is a schematic cross-sectional view of an example non-limiting (first or second) engine cylinder and (first or second) sleeve in FIG. 3B along line 3A-3A (across the thrust and anti-thrust regions) according to various embodiments of the engine block present disclosure.

Therefore, the present disclosure provides a cylinder block 10 for an internal combustion engine wherein the cylinder sleeves 20, 22 maintain position—rotationally within the cylinder (about axis 25 in FIG. 3A) and axially within the cylinder (along axis 25 in FIG. 3A). As described herein, the cylinder sleeves 20, 22 include a tapered cross-section along the longitudinal axis 25 of each cylinder which prevents undesirable axial movement of the cylinder sleeves 20, 22 due to thermal expansion. The cylinder sleeves 20, 22 also include an elliptical cross-section in plan view (FIG. 1) to prevent rotational axis within the cylinder (about axis 25 in FIG. 3A). Accordingly, a cylinder block according to the present disclosure includes a first cylinder 12, a first cylinder sleeve 20, a second cylinder 14, and a second cylinder sleeve 22. The first cylinder 12 defines a first cylindrical wall 16 while the second cylinder 14 defines a second cylindrical wall 18. The first cylinder sleeve 20 lines the first cylindrical wall 16 while the second cylinder sleeve 22 lines the second cylindrical wall 18. Each of the first and the second cylinder sleeves 14, 22 define a thrust sleeve region 28, an anti-thrust sleeve region 30 opposite the thrust sleeve region 28, and a pair of Siamese sleeve regions 32. The outer wall 26 of each of the first and second cylinder sleeves 20, 22 progressively widens along longitudinal axis 25 (toward the top sleeve surface 34) of each of the first and second cylinder sleeves 20, 22. However, the thick widths 52 at the thrust and anti-thrust sleeve regions 28, 30 are each greater than the Siamese region widths 52 at the Siamese sleeve regions.

Figure 3B:
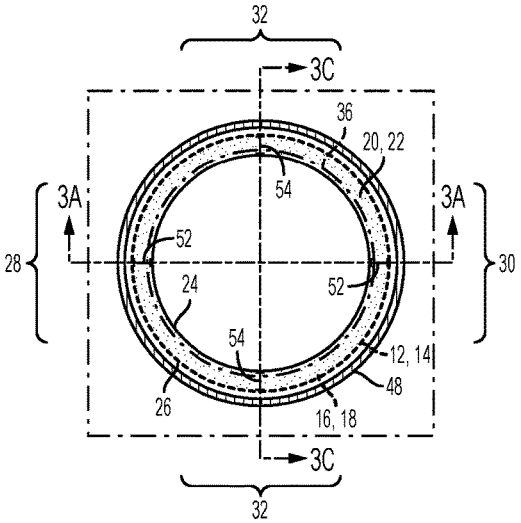
FIG. 3B is a schematic plan view of (first or second) engine cylinder and (first or second) cylinder sleeve with the stopper and combustion bead shown.
Figure 3C:
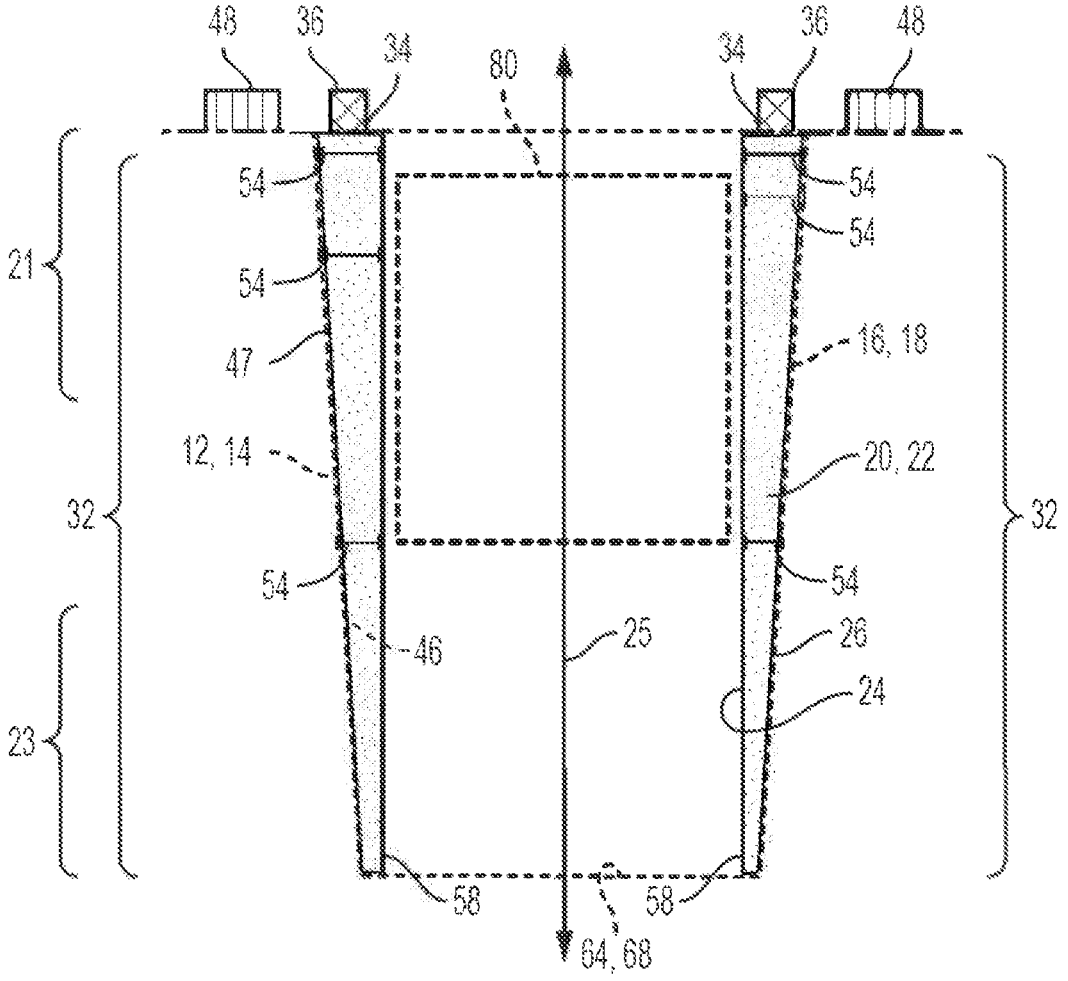
FIG. 3C a schematic cross-sectional view of an example non-limiting (first or second) engine cylinder and (first or second) sleeve in FIG. 3B along line 3C-3C (across the Siamese regions) according to various embodiments of the engine block present disclosure.
Figure 4:
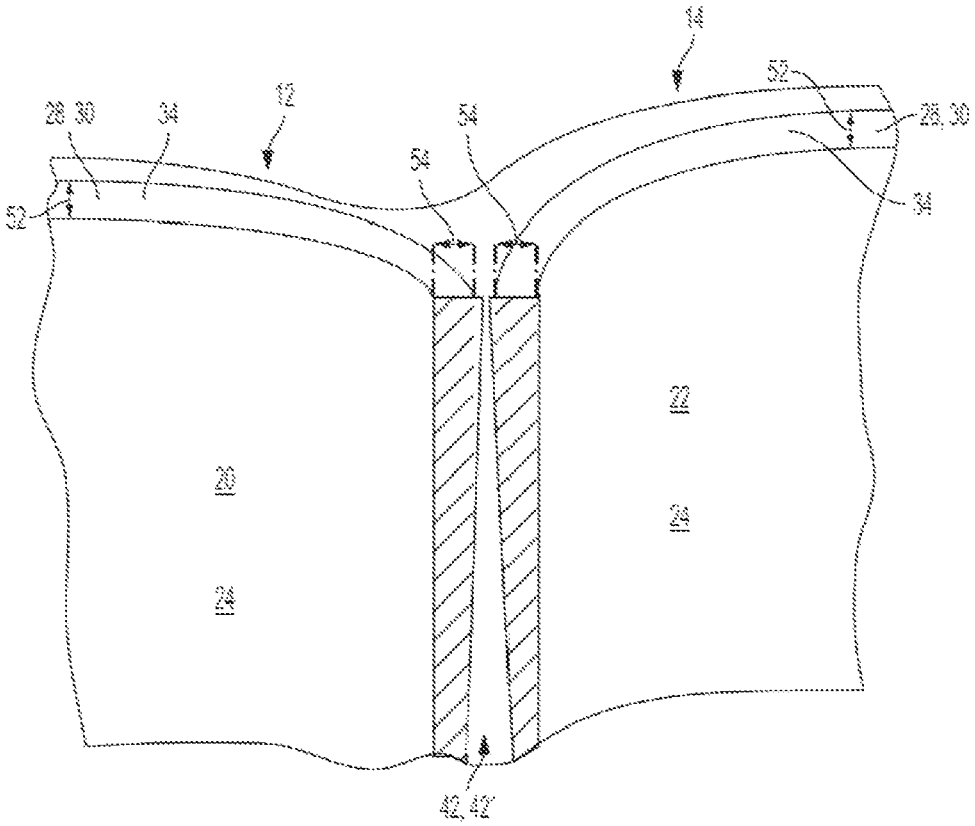
FIG. 4 illustrates a partial cross-sectional view of a first cylinder sleeve and a second cylinder sleeve according to the present disclosure.

The aforementioned configuration accommodates the thermal expansion which may occur in the first and second cylinder sleeves 20, 22 which occurs in the regions (Siamese regions) disposed between each cylinder. It is understood that water jacket disposed proximate to the thrust and anti-thrust regions prevents the thrust sleeve region 28 and the anti-thrust sleeve regions 30 from overheating and undergoing excessive thermal expansion. Moreover, the elliptical configuration of each of the first and second cylinder sleeves 20, 22 at and proximate to each top sleeve surface 34 also prevents each of the first and second cylinder sleeves 20, 22 from rotating within each cylinder or cylinder bore. As shown in FIGS. 3A-3C, the inner and outer walls 24, 26 are substantially co-cylindrical within each corresponding cylinder. The inner and outer walls 24, 26 for each if the first and second cylinder sleeves 20, 22 define a top sleeve surface 34 configured to accommodate at least part of a head gasket 36.

In the aforementioned example, non-limiting embodiment, the thrust sleeve region 28 and the anti-thrust sleeve region 30 of each of the first and second cylinder sleeves 20, 22 may be aligned with a corresponding thrust region 29 (FIG. 1) and a corresponding anti-thrust region 31 (FIG. 1) in each of the first and second cylinders 12, 14. The pair of Siamese regions 42, 42' in the first and second cylinders 12, 14 may also be disposed opposite to each other. However, it is understood that one Siamese region 42 of the pair of Siamese regions 42 defined by the first cylinder 12 may be disposed adjacent to a Siamese region 42' in the pair of Siamese regions 42' for the second cylinder 14. Similarly, a Siamese sleeve region 32 in the first cylinder sleeve 20 may be disposed proximate to another Siamese sleeve region 32 in the second cylinder sleeve 22. The cylinder block 10 experiences very high temperatures in the Siamese regions 42 (and Siamese sleeve regions 32) between each cylinder 12, 14 while the thrust and anti-thrust regions 29, 31 (FIG. 1) of the cylinder block 10 experience relatively lower temperatures due to the proximate water jackets 82. Moreover, in light of the combustion occurring closer to the top portion 21 of each of the cylinders 12, 14, the top portion 21 of each of the first and second cylinders 12, 14 (and each of the first and second cylinder sleeves 20, 22) experience a higher temperature gradient relative to the bottom portion 23 of each of the first and second cylinders 12, 14 and each of the first and second cylinder sleeves 20, 22. See FIG. 3A.

The outer wall 26 of each of the first and second cylinder sleeves 20, 22 may define an elliptical cross section 44 while the inner wall 24 of each of the first and second cylinder sleeves 20, 22 defines a circular cross section 46. The first and the second cylinders 12, 14 each define a tapered cylinder bore 47 configured to align with the elliptical cross section 44 of the outer wall 26 of the corresponding first and second cylinder sleeves 20, 22. The tapered cylinders (or cylinder bores) 12, 14 are tapered along longitudinal axis 24 (FIG. 3A). It is further understood that the Siamese sleeve regions 32 in each of the first and second cylinder sleeves 20, 22 are configured to undergo thermal expansion when the internal combustion reaches a predetermined temperature. However, due to the tapered nature of each of the first and the second cylinder sleeves 20, 22 along the longitudinal axis 25, each cylinder sleeve 20, 22 will not thermally expand to the point at which the sleeves 20, 22 expand and disrupt the gasket seal 36 which interfaces with the cylinder head (not shown). As shown, the top sleeve surface 34 for each of the first and the second cylinder sleeves 14, 22 may be configured to support a head gasket 36. In the aforementioned example, non-limiting embodiment, a combustion bead 48 may also be spaced apart from each of the first and the second cylinder sleeves 14, 22 yet surrounds each of the first and the second cylinder sleeves 14, 22.

It is also understood that the thrust sleeve region 28 and the anti-thrust sleeve region 30 each define a thick width 52 at the top sleeve surface 34 of each of the first and second cylinder sleeves 20, 22 while each Siamese region in the pair of Siamese regions 42, 42' in the first and second cylinder sleeves 20, 22 defines a Siamese region width 54 at the top sleeve surface 34 of each of the first and second cylinder sleeves 20, 22. The thick widths 52 in the anti-thrust sleeve regions 30 and thrust sleeve regions 28 are each greater than each of the corresponding Siamese region widths 54. Accordingly, the elliptical configuration 56 at each top sleeve surface 34 prevents each cylinder sleeve 20, 22 from rotating within each cylinder bore 12, 14. As shown in FIGS. 3A-3C, the cylinder sleeve thickness 52 (thick width 52) progressively increases along the longitudinal axis 25 in the thrust sleeve region 28 and the anti-thrust sleeve regions 30 of each of the first and second cylinder sleeves 20, 22 while the cylinder sleeve width (Siamese region width 54) also progressively increases along the longitudinal axis 25 in each Siamese sleeve region 32. However, it is understood that thick width 52 at any point along axis 25 is greater than any corresponding Siamese region width 54 along axis 25. Therefore, as shown in FIG. 3C, the Siamese region width 54 at the top sleeve surface 34 of each of the first and the second cylinder sleeves 14, 22 similarly progressively increases (like that in the anti-thrust region and thrust region) along the longitudinal length/axis 25 of the cylinder sleeve 20, 22.

Figure 5:
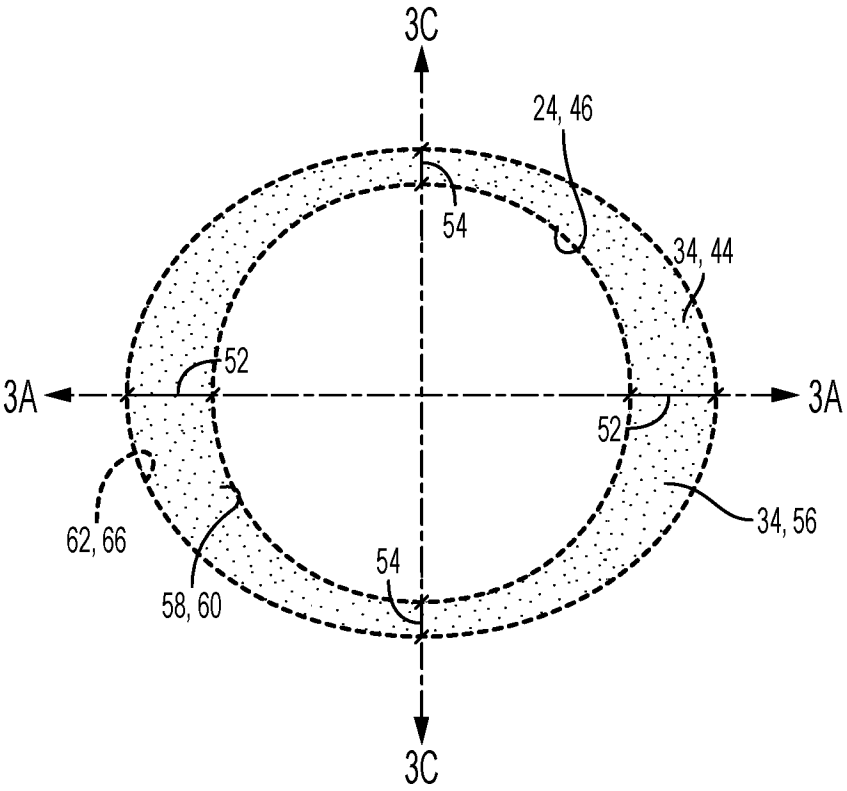
FIG. 5 is a plan view of an example (first or second cylinder) and its corresponding cylinder sleeve.

Accordingly, referring now to FIG. 5, in the aforementioned, non-limiting example embodiment, the top sleeve surface 34 of each of the first and the second cylinder sleeves 14, 22 defines an elliptical shape 56 while the bottom edge 58 of each of the first and the second cylinder sleeves 14, 22 defines a circle shape 60. Similarly, the top opening 62 of each of the first and the second cylinders 12, 14 defines an elliptical configuration 66 while a bottom surface 64 of each of the first and the second cylinders 12, 14 defines a circle configuration 68. Lastly, it is understood that the cylinder block 10 of the present disclosure may optionally include a plurality of sets 50 of cylinder assemblies (as shown in FIG. 1) wherein each set 50 of cylinders assemblies includes the first cylinder 12, the first cylinder sleeve 20, the second cylinder 14, and the second cylinder sleeve 22.

While at least one example non-limiting embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A cylinder block of an internal combustion engine comprising:

a first cylinder having a first cylindrical wall;

a first cylinder sleeve lining the first cylindrical wall having a top sleeve surface and a bottom sleeve surface;

a second cylinder having a second cylindrical wall; and a second cylinder sleeve lining the second cylindrical wall, the second cylinder sleeve including a top sleeve surface portion and a bottom sleeve surface portion, each of the first and the second cylinder sleeves having an inner wall and an outer wall which define a thrust sleeve region, an anti-thrust sleeve region opposite the thrust sleeve region, and a pair of Siamese regions;

wherein the inner and outer walls for each of the first and second cylinder sleeves being substantially co-cylindrical within the first cylinder and the second cylinder respectively, and each top sleeve surface and the top sleeve surface portion are configured to accommodate at least part of a head gasket, and wherein the outer wall of each of the first and second cylinder sleeves progressively, widens along longitudinal axis from corresponding ones of the bottom sleeve surface and the bottom sleeve surface portion toward a top sleeve surface and top sleeve surface portion, wherein each of the first and second cylinder sleeves has a non-uniform thickness defined by a first thickness at the top sleeve surface portion that tapers to a second thickness at the bottom sleeve surface portion in the thrust region and the anti-thrust region and a third thickness, that is less than the first thickness, at the top sleeve surface portion that tapers to a fourth thickness at the bottom sleeve surface portion in each of the Siamese regions.

2. The cylinder block as defined in claim 1 wherein the thrust sleeve region and the anti-thrust sleeve region of each of the first and second cylinder sleeves are aligned with a corresponding thrust region and a corresponding anti-thrust region in each of the first and second cylinders.

3. The cylinder block as defined in claim 2 wherein the pair of Siamese regions in the first and second cylinders disposed opposite to each other, and one of the pair of Siamese regions defined the first cylinder is disposed adjacent to a Siamese region of the second cylinder.

4. The cylinder block as defined in claim 3 wherein the outer wall of each of the first and second cylinder sleeves defines an elliptical cross section and the inner wall of each of the first and second cylinder sleeves defines a circular cross section.

5. The cylinder block as defined in claim 4 wherein the first and the second cylinder each define an elliptical cylinder bore configured to align with the elliptical cross section of the outer wall of the corresponding first and second cylinder sleeves.

6. The cylinder block as defined in claim 5 wherein each of the Siamese sleeve regions in the first and second cylinder sleeves are configured to undergo thermal expansion when the internal combustion reaches a predetermined temperature.

7. The cylinder block as defined in claim 6 wherein the top sleeve surface and top sleeve surface portion of corresponding ones of the first and the second cylinder sleeves is configured to support a stopper.

8. The cylinder block as defined in claim 7 wherein a combustion bead is spaced apart from each of the first and the second cylinder sleeves yet surrounds each of the first and the second cylinder sleeves.

9. The cylinder block as defined in claim 8 further comprising a plurality of sets of cylinder assemblies wherein each set of cylinders assemblies includes the first cylinder, the first cylinder sleeve, the second cylinder, and the second cylinder sleeve.

10. The cylinder block as defined in claim 9 wherein the thrust sleeve region and the anti-thrust sleeve region each define a thick width at the top sleeve surface of each of the first and second cylinder sleeves while each Siamese region in the pair of Siamese regions in the first and second cylinder sleeves defines a Siamese region width at the top sleeve surface of each of the first and second cylinder sleeves.

11. The cylinder block as defined in claim 10 wherein the thick width is greater than the Siamese region width.

12. The cylinder block as defined in claim 11 wherein the Siamese region width at the top sleeve surface and top sleeve surface portion of corresponding ones the first and the second cylinder sleeves is equal to a sleeve thickness along a longitudinal length of the cylinder sleeve in each Siamese region.

13. The cylinder block as defined in claim 12 wherein the top sleeve surface and top sleeve surface portion of corresponding ones of the first and the second cylinder sleeves defines an elliptical shape while the bottom sleeve surface and bottom sleeve surface portion of corresponding ones of the first and the second cylinder sleeves defines a circle shape.

14. The cylinder block as defined in claim 12 wherein a top opening of each of the first and the second cylinders defines an elliptical shape while the bottom sleeve surface and bottom sleeve surface portion of corresponding ones of the first and the second cylinders defines a circle shape.

* * * * *